US005806220A

United States Patent [19]

Flammini

[11] Patent Number: 5,806,220

[45] Date of Patent: Sep. 15, 1998

[54] INFORMATION DISPLAYER WITH INTERCHANGEABLE BOARDS

[75] Inventor: Fausto Flammini, Rome, Italy

[73] Assignees: Videotron s.r.l., Rome, Italy; New Board International, London, England

[21] Appl. No.: 781,111

[22] Filed: Jan. 9, 1997

Related U.S. Application Data

[63] Continuation of Ser. No. 731,686, Oct. 17, 1996, abandoned, which is a continuation of Ser. No. 367,132, filed as PCT/IT93/00071, Jul. 5, 1993 published as WO94/01853 Jan. 20, 1994, abandoned.

[30] Foreign Application Priority Data

| | | | |
|---|---|---|---|
| Jul. 6, 1992 | [IT] | Italy | RM92A0511 |
| Sep. 14, 1992 | [IT] | Italy | RM92A0663 |

[51] Int. Cl.[6] ..... G09F 77/00

[52] U.S. Cl. ..... 40/476; 40/463; 40/501; 40/510; 40/516; 40/517

[58] Field of Search ..... 40/463, 470, 476, 40/501, 515, 516, 517, 467, 473, 510

[56] References Cited

U.S. PATENT DOCUMENTS

| | | | |
|---|---|---|---|
| 685,771 | 11/1901 | Langer | 40/516 |
| 765,464 | 7/1904 | Flachsbart | 40/515 X |
| 843,837 | 2/1907 | McMaster | 40/517 |
| 924,416 | 6/1909 | Beile | 40/516 |
| 1,284,656 | 11/1918 | Green | 40/516 |
| 1,460,619 | 7/1923 | Sumner | 40/516 |
| 1,599,646 | 9/1926 | Clark . | |
| 1,700,435 | 1/1929 | Duval . | |
| 1,880,210 | 10/1932 | Poliakoff et al. | 40/476 |
| 1,899,780 | 2/1933 | Turner | 40/476 |
| 1,940,820 | 12/1933 | Sharaf | 40/476 |
| 2,195,249 | 3/1940 | Hutchinson | 40/476 X |
| 2,891,325 | 6/1959 | Breuning | 40/467 |
| 4,176,483 | 12/1979 | Bailey | 40/467 |
| 5,031,346 | 7/1991 | Herring et al. | 40/463 |
| 5,440,214 | 8/1995 | Peeters | 40/467 X |

FOREIGN PATENT DOCUMENTS

| | | | |
|---|---|---|---|
| 2647246 | 11/1990 | France . | |
| 561237 | 10/1932 | Germany | 40/516 |
| 182964 | 8/1922 | United Kingdom . | |

*Primary Examiner*—Kenneth J. Dorner
*Assistant Examiner*—Andrea Chop
*Attorney, Agent, or Firm*—Baker & Botts, L.L.P.

[57] ABSTRACT

An information displayer with interchangeable boards for use in displaying advertising messages. Two sets of boards are disposed on two chains respectively, with each chain rotating about a pair of pinions. One pinion is stationary while the other is connected to a stepping motor. Hooks on a rigid bar grasp openings in the boards to release and display the boards. A pre-programmed microprocessor controls the stepping motor, permitting the boards to be displayed in any selected manner.

7 Claims, 14 Drawing Sheets

INFORMATION DISPLAYER WITH INTERCHANGEABLE BOARDS

This application is a continuation of application Ser. No. 08/731,686, filed on Oct. 17. 1996, now abandoned, which in turn is a continuation of Ser. No. 08/367,132, filed as PCT/IT93/00071, Jul. 5, 1993 published as WO94/01853, Jan. 20, 1994, now abandoned.

The present invention relates to an information displayer with interchangeable boards.

More particularly, the invention relates to a device of the above kind that allows to display different boards, particularly advertising boards in a selective manner.

It is well known to those who are experts in the art that more or less recently different kinds of devices have been realized, said devices allowing to change the imagine displayed towards the public.

A first device of this kind provides a number of horizontal triangular-shaped elements that can rotate about their horizontal axis, so that, rotating in synchronism the different faces, it is possible to change the message that is visible to the public according to a predetermined timing.

Is is well evident that this kind of device is rather limiting under a functional point of view: in fact, it allows the vision of only three different advertising messages, and only according to a rigid sequence.

Furthermore, if it is desired to replace the advertising message, it is practically necessary to replace all the device, such an operation involving high costs and remarkable practical drawbacks.

A second kind of device to display different images to the public already available on the market is the one comprising a sheet wound on two rolls and having a sequence of images to be displayed printed on it.

Winding and unwinding the sheet on said rolls it will be possible to change the message shown to the public.

In this case the number of available messages can also be high, although it is in any case is limited by the sizes of the sheet.

However, the above device does not allow to propose the messages according to a casual and selective sequence, since the choice is binded by the order of the messages printed on the sheet Furthermore, it is very difficult, troublesome and expensive, or even impossible or economically not convenient, to replace the sheet with another one having a different group of advertising messages.

In GB-A-182 964 a picture displaying apparatus is disclosed, said apparatus comprising removable picture roll drums or carriers and preferably means for rendering the picture exhibiting mechanism inoperable unless it is in the correct operating position.

In U.S. Pat. No. 1,700,435 an automatic advertising machine is described wherein a number of advertisements are singly and consecutively brought into view.

In view of the above, the Applicant has studied and realized a displayer of multiple information or images that allows to display the images according to a casual sequence. i.e. according to any pre-established sequence.

Moreover the solution according to the invention allows to realize a displayer wherein the images are arranged over boards that are selectively displayed.

A further object of the present invention is that of realising an image displayer wherein the information over the boards are included in two "loaders" that can be easily and quickly replaced without the need to move or modify the structure of the displayer.

It is therefore specific object of the present invention an information displayer with interchangeable boards comprising at least a container of n boards, provided with means to selectively take out said n boards; means to grasp the board to be displayed; and means to bring the board in a display position and to bring back the same into the container.

According to a first preferred embodiment of the displayer according to the invention, the displayer comprises two carrier elements, or "loaders", each for n boards, provided substantially one above the other; means to grasp the board to be displayed from the upper loader or from the lower loader; and means to bring the same panel in a display position, and then to bring back the same into the upper or lower loader wherefrom it has been taken out.

Particularly, each one of said loaders is provided with n supports, preferably made up by cylindrical supports preloaded by harmonic steel spring, wherefrom the boards are taken out to be displayed, or whereon are bring back after the display, and whereon the boards remains wound when they are not used.

Preferably, according to the invention, said loaders are releasably coupled to the displayer so that they can be replaced with other ones containing different boards.

Said loaders are preferably realized with a stepping motion, with a number of steps corresponding to the number of boards provided.

The movement is preferably obtained by a stepping motor for each loader, controlled by a pre-programmed microprocessor, that operates a toothed flange so as to transmit the motion to the same loader.

Further according to the invention, said means to grasp the board to be displayed and to bring it in a display position, provided both for the upper loader and for the lower loader comprises movable elements arranged at 45° each other on a rotating roll, projecting from the roll to grasp the board by means of a leverage system controlled by an actuator device, preferably a solenoid.

In a second preferred embodiment of the displayer according to the invention, said means to selectively take out said n boards comprises a first pin element, provided externally on the container, slidable along a slot realized on the same container, and couplable with a hole realized on the boards: a second pin element, provided at the bottom of the container, and parallelly disposed with respect to the same container, couplable with said hole realized on the boards, said container being movable along a direction parallel to the axis of said pin elements.

Preferably, said container is realized with a stepping motion, with a number of steps corresponding to the number of boards provided.

The motion is preferably obtained by a stepping motor, controlled by a preprogrammed microprocessor, that operates a cam having n tracks.

Further, said first pin element is moved along said slot by an electric motor.

Said means to grasp the board to be displayed e to bring it in a display position are preferably made up by movable elements, which are arranged on a rotatable roll at 120° each other, and which can be projected from the roll to grasp the board, or withdrawn within the same roll to release the board by an actuating device, preferably a solenoid.

Said means to bring the board in a display position and to bring it back within the housing cylinder can be provided, apart from the above mentioned roll rotatable in both the directions, one or more magnetic strings to properly position the board.

Still according to the invention, said container is releasably coupled to the displayer so that it can be replaced with another one containing different boards.

According to a third embodiment of the displayer according to the present application, two set of boards are provided, disposed respectively according to an articulated chain rotating around pulleys means, at least a motor being provided to move said chains.

Preferably, it is provided only one motor that operates said two board chains, rotating in both the directions, said motor being connected by a belt or other suitable means with one of the pulley of each chain.

Further according to the invention, each one of said boards can be made up of a cylindrical container, having inside a hub over which the sheet rolls up, spring means being provided so as to determine the automatic roll up of the sheet around the hub.

Again according to the invention, the selective display of the boards occurs bay a rigid bar provided on the front portion of the displayer according to the invention, said bar being moved by a motor and motion transmission means, preferably chain means that rotates around sprocket means, and coupled with coupling means provided on the outer edge of the board.

Again according to the invention, said container is provided with n housings for n boards.

On each board it can be laterally provided a set of perforations matchable with said movable elements, said perforations being spaced each other of a pitch corresponding to the distance between said movable elements.

Furthermore, two metallic reinforcing strips, having perforations, and eventually inner reinforcement metallic strips, can be provided on said boards.

Behind the board displayed a further reinforcement element can be provided.

The present invention will be now described in the following, in an illustrative but not limitative way, according to its preferred embodiments, with particular reference to the figures of the enclosed drawings, wherein.

Figure 1:
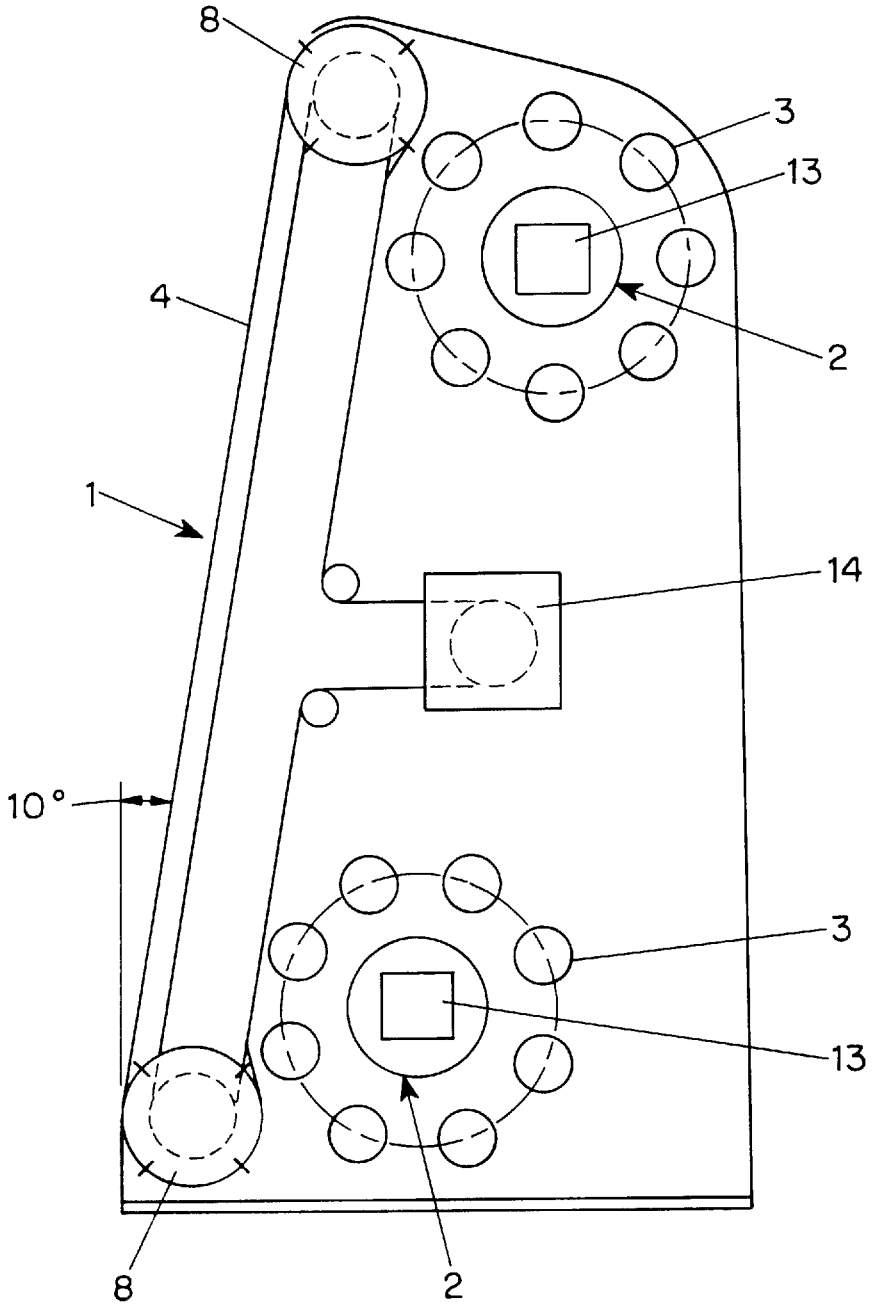
FIG. 1 is a lateral view of a first embodiment of the information displayer according to the invention.
Figure 2:
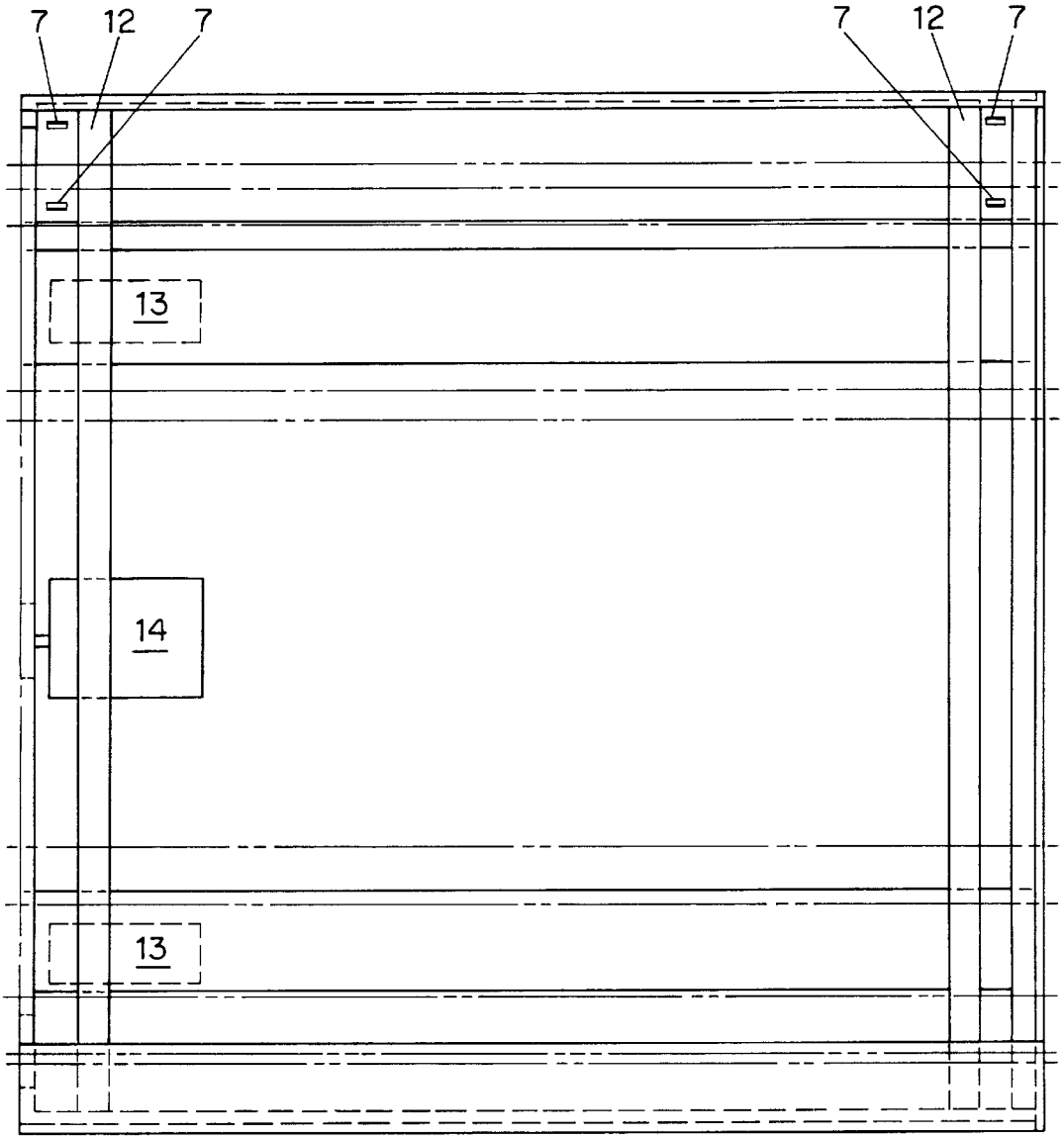
FIG. 2 is a front view of the information displayer of FIG. 1.

Referring now to FIGS. 1 to 6 of the enclosed drawings, it can be noted that the information displayer according to the invention is an electromechanical device provided with an automatic selective system that allows to display alternatively, from the above or from the bottom and according to a desired sequence, a number n of images printed on the boards.

The displayer 1 comprises two elements 2 or "loaders" bearing the boards, arranged one at the top and one at the bottom, and having each one n cylinder 3 with boards 4, said loaders 2 having a rotating motion, as it will be more clear in the following.

Every single loader 2 is provided, as already said, with n housing cylinders 3, one for every board 4 to be displayed. In the figures, every loader 2 provides eight cylinders 3.

Figure 6:
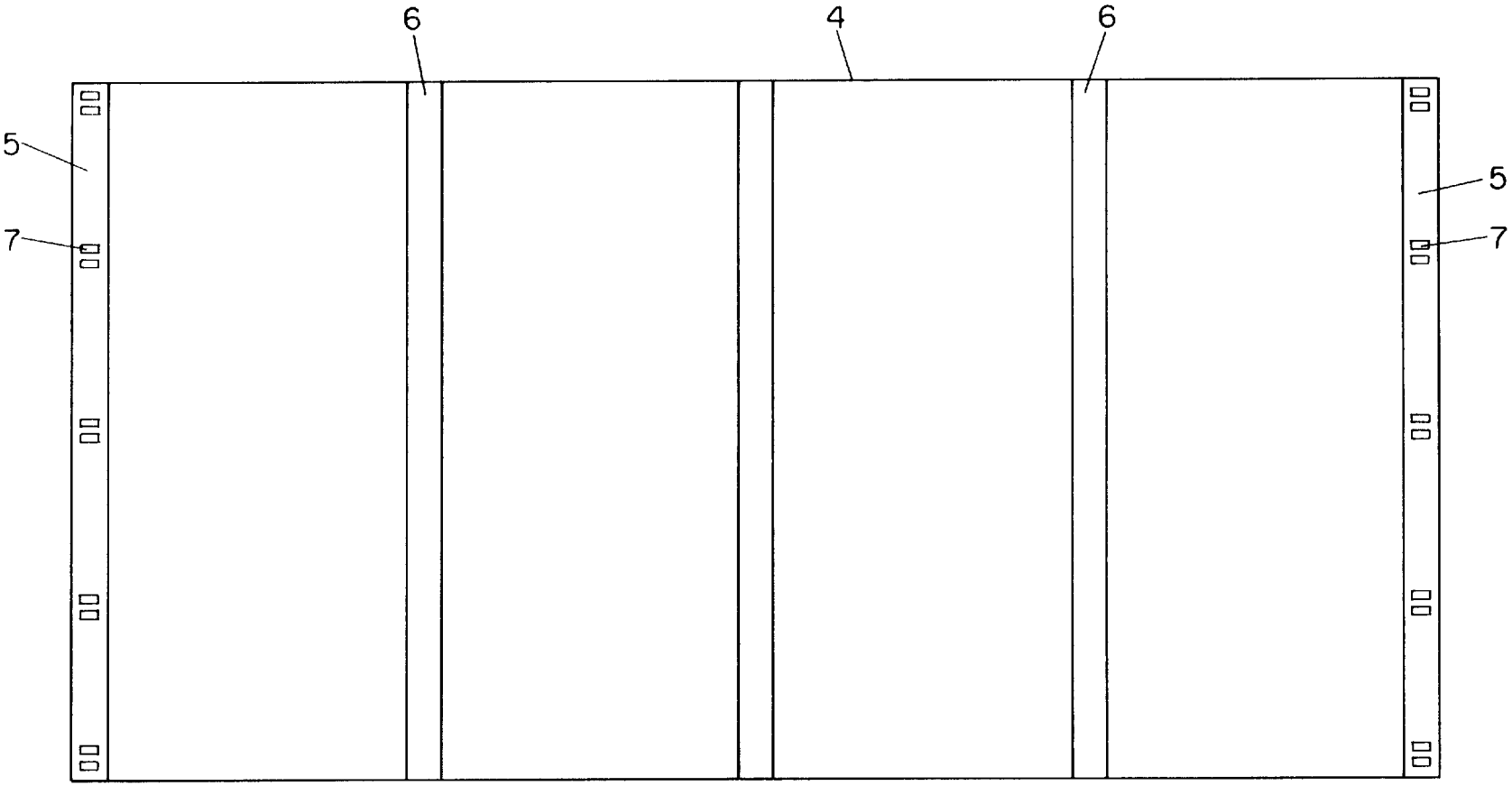
FIG. 6 is a plan view of the board of the displayer of FIG. 1.
Figure 7:
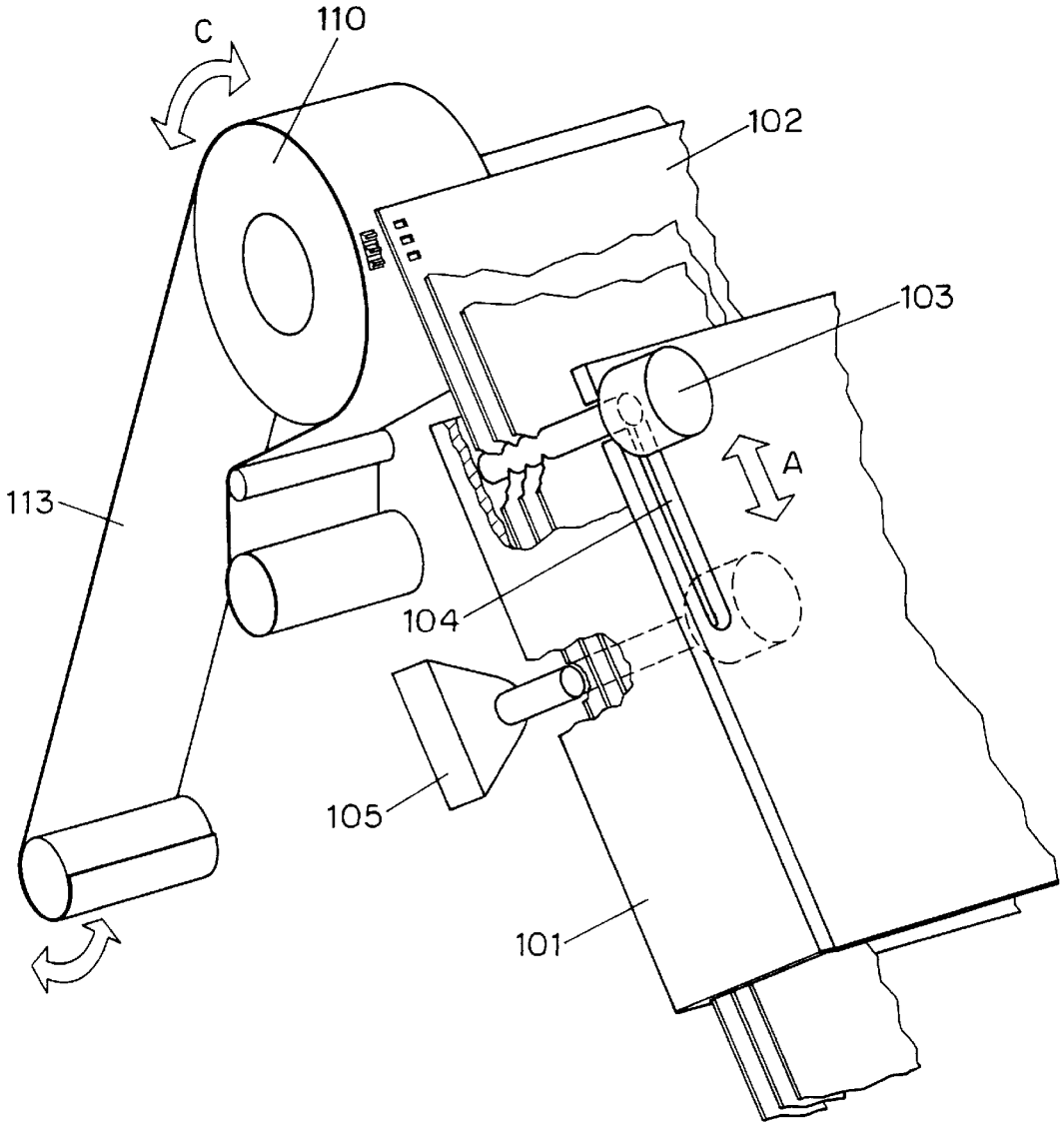
FIG. 7 is a partial, cut-away view of a second embodiment of the displayer according to the invention.
Figure 8:
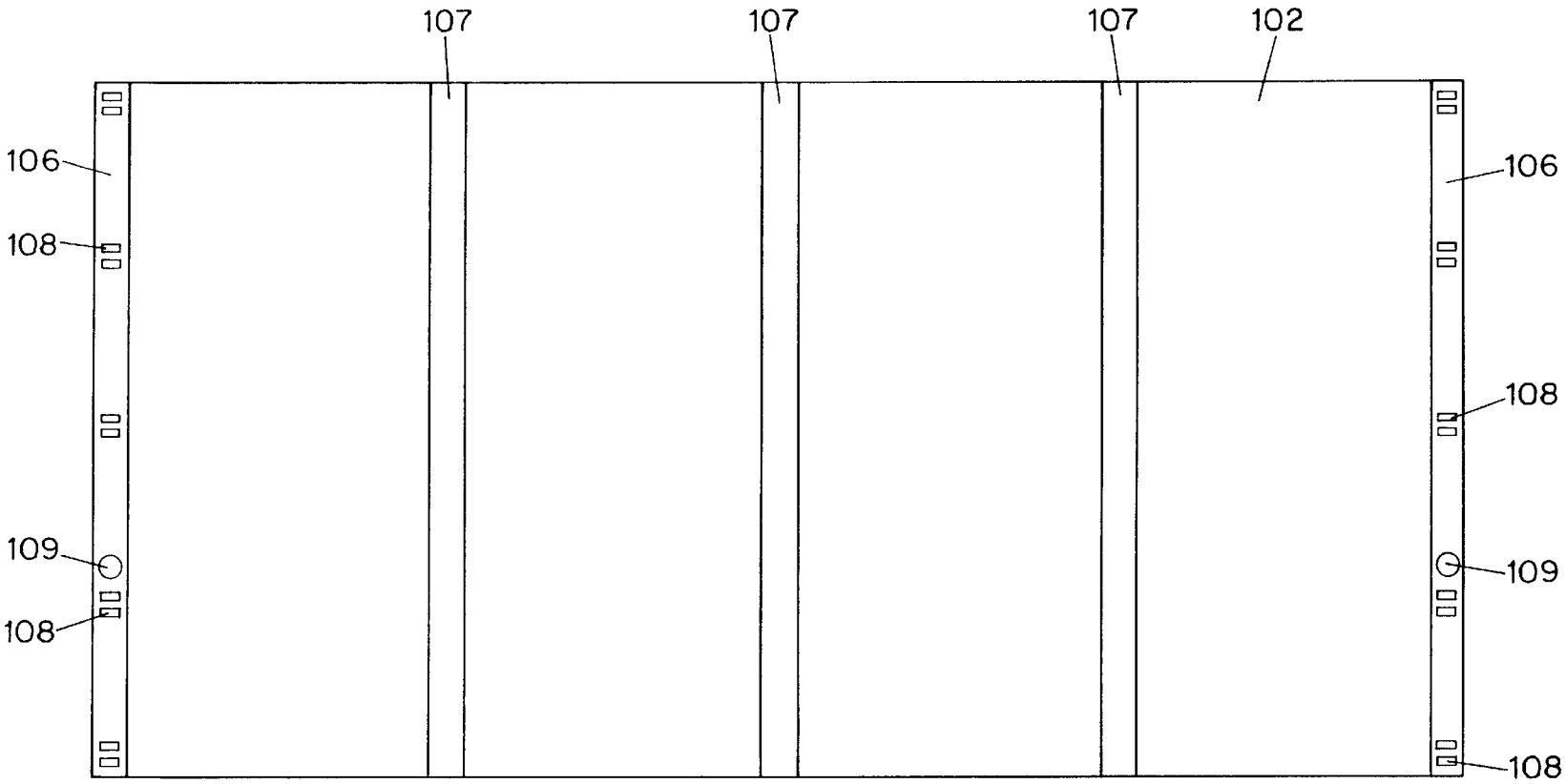
FIG. 8 is a plan view of a board of the displayer of FIG. 7.

Each one of the boards 4, see in particular FIG. 6, is provided with transverse steel strips 5, 6, the outer ones being provided with perforations 7 spaced of a predetermined pitch.

Figure 3:
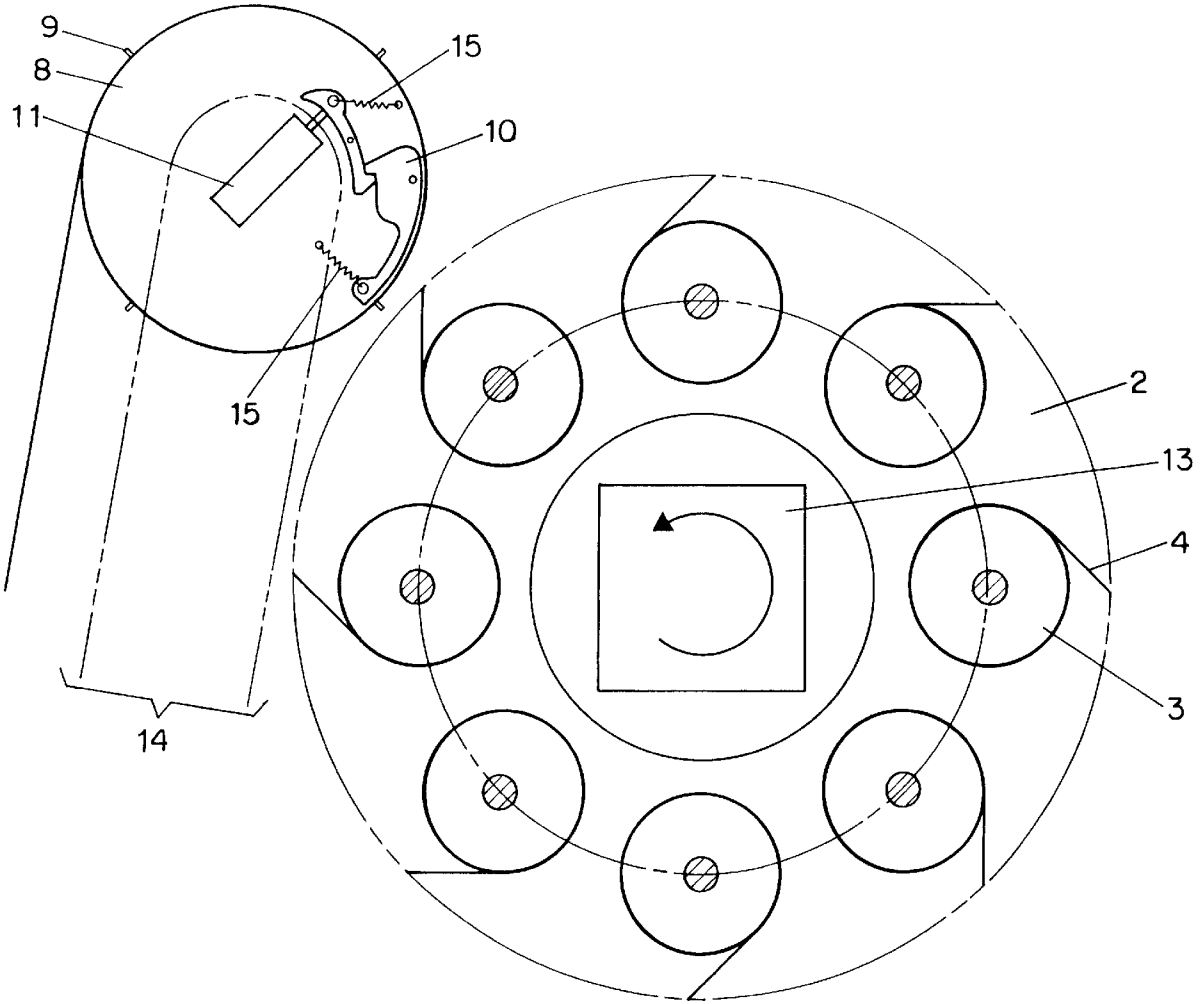
FIG. 3 is a view in vertical section of the rotatable roll and of the upper "loader" of the information displayer of FIG. 1.
Figure 4:
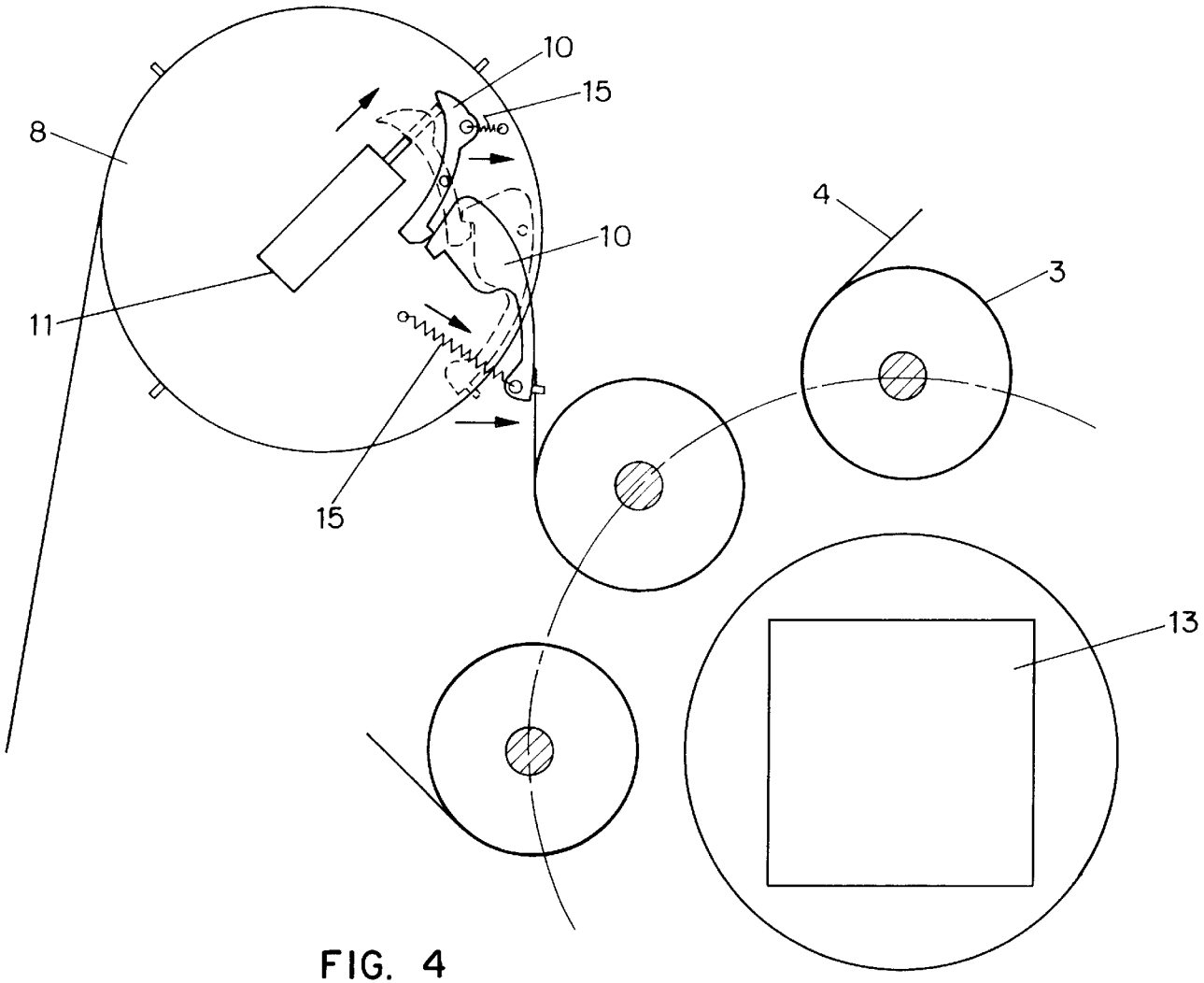
FIG. 4 is a view of a particular in vertical section showing the lever mechanism controlled by the solenoid for the grasping step of the board of the displayer of FIG. 1.

The arrangement to display the boards 4, both for the upper loader 2 and for the lower loader 2, is made up, as it can be observed in FIGS. 3 and 4, of a roll 8 provided with eight sectors 9, preferably movable sectors, arranged at 45° each other, operated by suitable levers 10 controlled by the solenoid 11.

Figure 5:
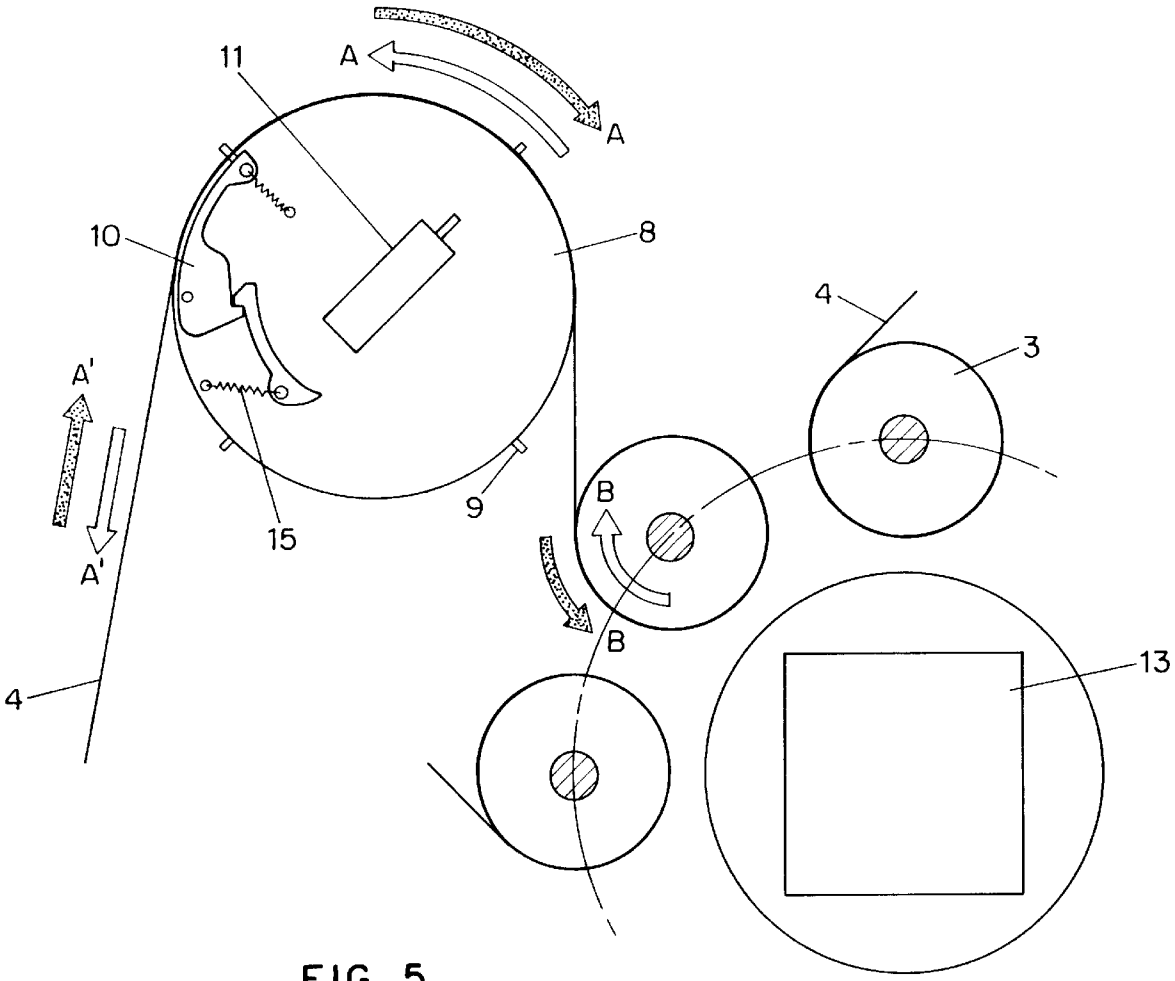
FIG. 5 is a view in vertical section of a particular of the displayer of FIG. 1 showing the outlet and return path of the board.

The roll 8 can rotate in the directions of arrows A of FIG. 5.

It is further provided a plurality of magnetic belts 12 (see FIG. 2) that are useful to obtain a proper display of the board 4.

The steel strips 5, 6 provided on each board 4 have the goal to reinforce the same allowing to obtain an optimum display and to reinforce the edges that engage with the movable sectors and over which said perforations 7 are realized to drag the board 4.

Obviously, in case the board 4 is realized with a material sufficiently resisting, it could be not necessary to provide said strips 6, 7.

The motion of the cylinders 3 according the direction of the arrows B in FIG. 5 is obtained by a stepping motor 13 having a number of steps corresponding to the number n of boards 4 provided.

Figure 12:
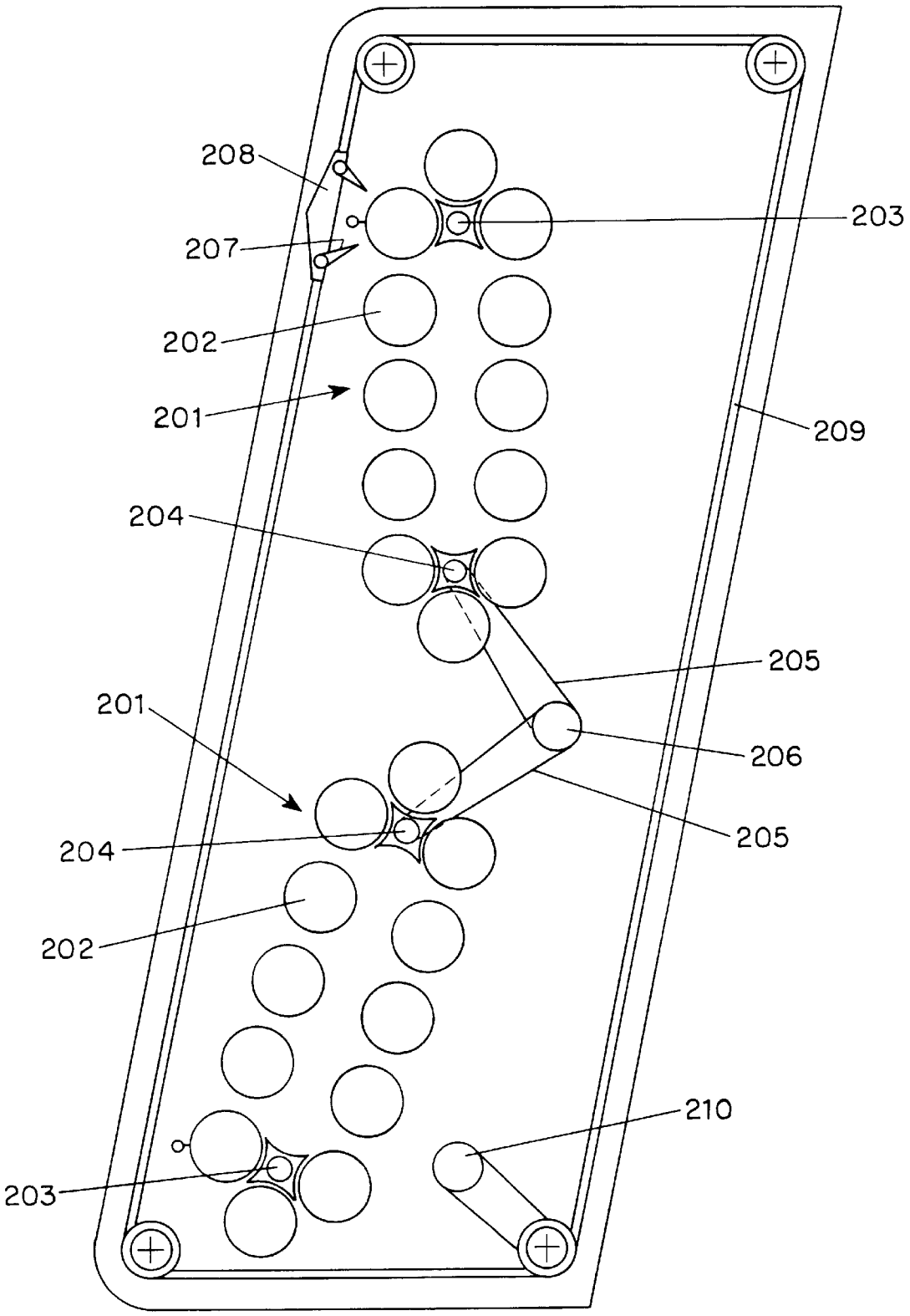
FIG. 12 is a lateral view of a third embodiment of the displayer according to the invention.

To display the different boards 4 according to suitable and pre-established sequences, the stepping motor 13 will be controlled by a microprocessor 215 as shown in FIG. 12 with a suitable software.

The operation of the displayer 1 according to the invention will be described in the following with reference to a displayer wherein the different boards 4 are sequentially displayed, but it is obvious that the same principles are valid in case of a casual pre-established display of the boards.

The upper loader 2 is positioned so as to present the end edge of the board 4 rolled up on the corresponding preloaded cylinder 3 along a perfect vertical direction, see in particular FIG. 3, so that the movable sector 8, moved by the solenoid 11, can be positioned within the corresponding perforation 7 on the edge of the same board 4. The same operation is valid for every other board 4.

Now, by means of a stepping motor 14, the roll 8 starts its rotation until reaching of the complete display of the board 4, see clear arrows A, A' of FIG. 5.

To bring back the board 4 just displayed in the original position, wound again within its cylinder 3, the roll 8 rotates in an opposite direction, according to the dark arrows A, A', helped during this rotation by the springs 15 provided within the cylinder 8 and loaded during the preceding unrolling step for the display.

It is to be noted how, at the same time of the beginning of the return step of the board 4 displayed, the movable sector 9 placed on the bottom roll 8 of the displayer 1 is already engaged with the end edge of the board prepared by the lower loader 2 according to the work sequence exposed above, being so possible to start a new and immediate display of a new board 4, in this case from the bottom to the above, so that which dead times usually necessary to change the board to be displayed are completely eliminated.

In order to obtain the display of all the n boards 4, it is sufficient that the upper and lower loaders 2, following to rotation due to the stepping motor 14, prepare the end edge of the next board 4 as described above and according to the alternation criteria between the upper one and the lower one.

From the above, it is well evident how, programming the stepping motors 13 of the loaders 2 by the already mentioned microprocessor, it will be possible to determine the desired casual display sequence of the various boards 4.

Coming now to observe FIGS. 7 to 11, it is shown a second embodiment of the displayer according to the invention comprising a container 101 for n boards 102, and movable, as it will be more specifically described in the following, along a direction perpendicular with respect to the plane of the boards 102.

The container 101 is provided with n housings (not shown), one for each board 102.

The container 101 has a first pin 103 slidable according to arrows A within a slot 104, provided externally with respect to the same container 101, and a second pin 105 provided at the bottom of the container 101.

Each one of the boards 102 (see FIG. 8) is provided with transverse steel strips 106, 107, the outer two of which (106) presents perforations 108 spaced of a predetermined pitch.

Always on the strips 106 it is provided an hole 109 for the insertion of the pins 103 and 105, as it will be evident in following. The arrangement to display the boards 102 is made up of a roll 110 provided with three movable sectors 111 arranged at 120° each other and operated according to the direction of arrow B by solenoids 112 (see FIG. 9).

Roll 110 rotates along directions indicated by arrow C.

It is provided a magnetic string 113 that allows to obtain an optimum display of the board 102.

The strips 106 and 107 provided on the board 102 attend to reinforce the same allowing at the same time to obtain its optimum display, and, moreover, to reinforce the edges that engage with the movable sectors 111, and over which the perforations are realized.

Obviously, in case the material of the board is sufficiently resistant, it could also be unuseful to provide said strips 106, 107.

The pin 103 is moved along the slot 104 by a motor (not shown).

The motion of the container 101 according to the direction of the arrow D is obtained by a stepping motor (not shown) and a cam (not shown) having a number of profiles corresponding to the number n of boards 102 provided.

To display the different boards 102 according to suitable and preestablished sequences, the stepping motor will be controlled by a microprocessor with a suitable software.

The operation of the information displayer according to the invention is as follows, and it is quite similar to the one of the displayer of FIGS. 1–6.

It will be now described in the following the way how the different boards 102 are sequentially displayed, but it obvious that the same principles are valid in case a preestablished casual display of the boards 102 is wished.

Figure 9:
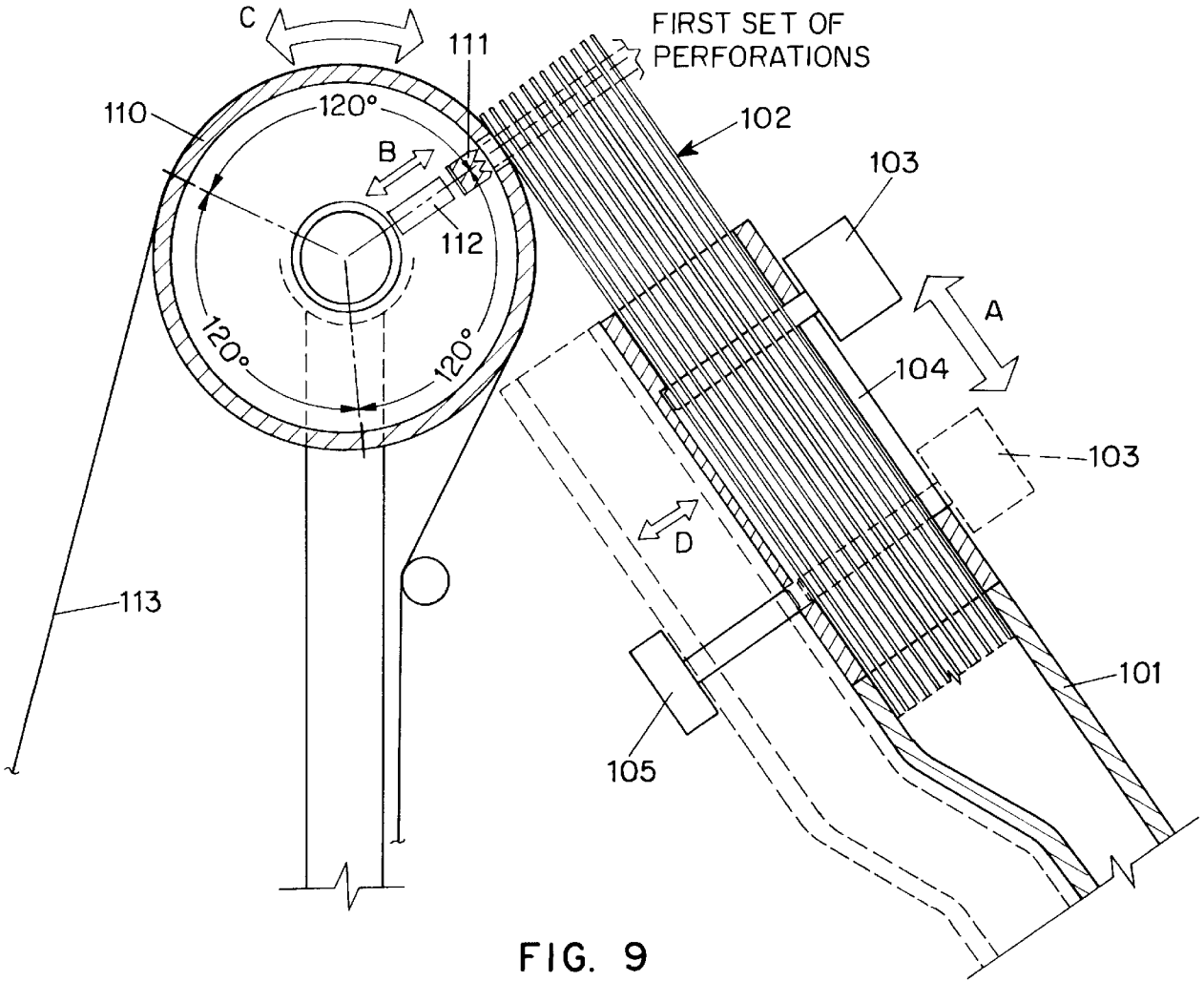
FIG. 9 is a view in vertical section of the displayer of FIG. 7.
Figure 10:
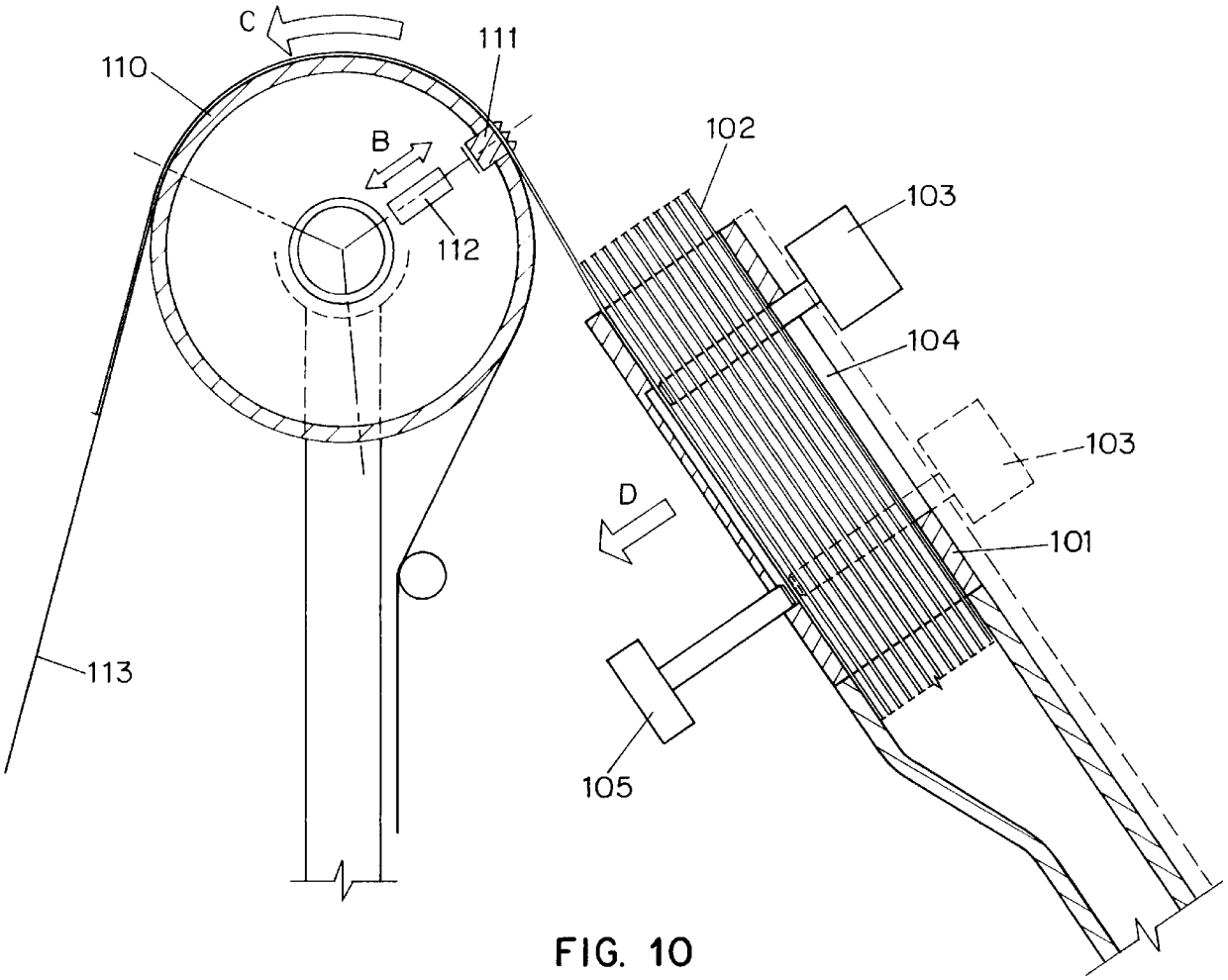
FIG. 10 is a view in vertical section of the displayer of FIG. 7 with the displayed board.
Figure 11:
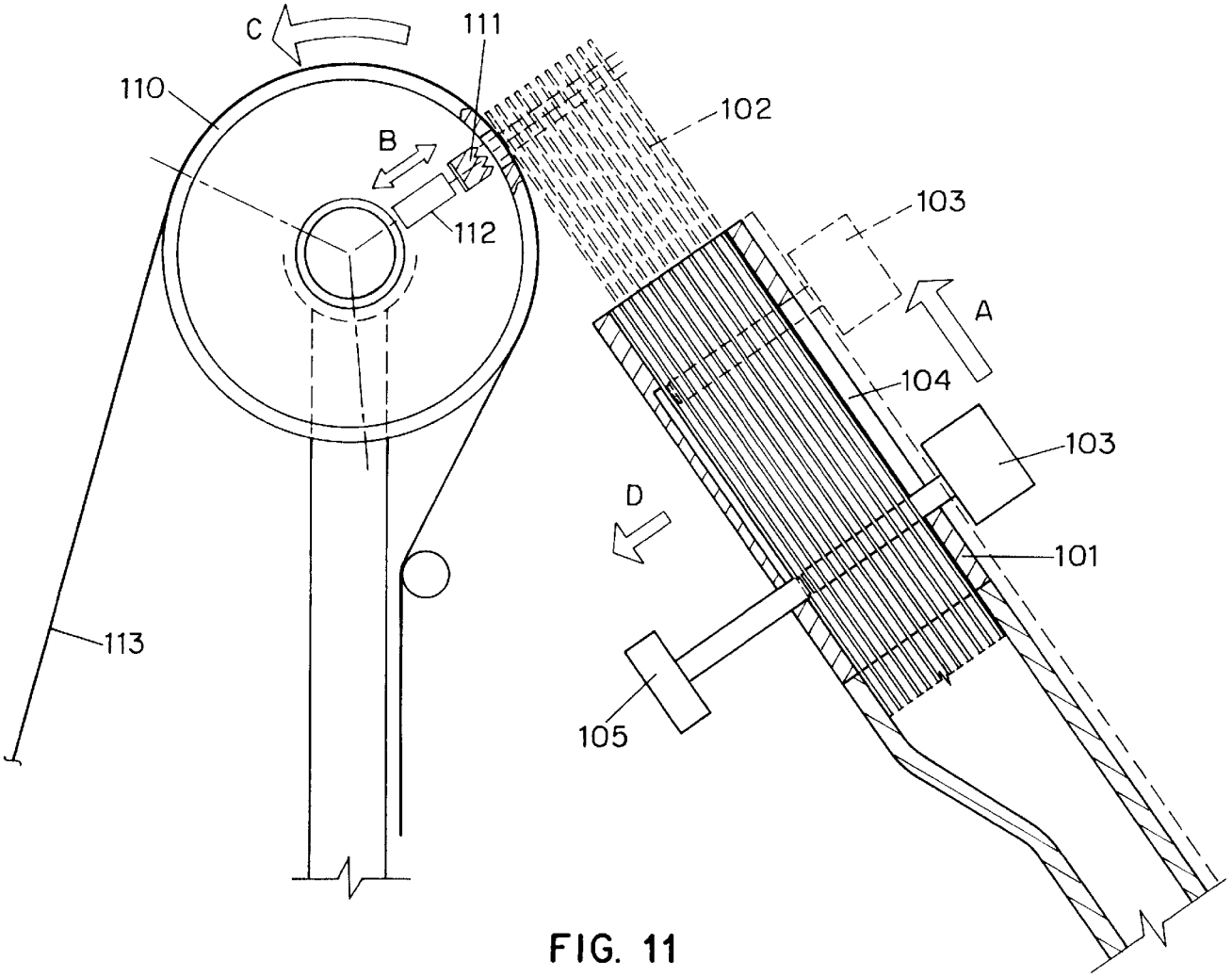
FIG. 11 is a further view in vertical section of the displayer of FIG. 7 having the board container displaced.

The container 111 will be in a completely lifted position, so that the pin 103, see dashed lines in FIG. 9, engages within the hole 109 of all the boards 102.

Advancing the pin 103 along the slot 104, until the position shown in full line in FIG. 9 is reached, the board 102 is brought with its first perforation 108 corresponding with the first movable sector 111.

Said sector 111 is operated by the solenoid 112 and therefore engages the board 102.

Now, by the stepping motor and the cam contour (not shown), the container 101 descend of a step so that the pin 103 disengage the hole 109 of the board 102 coupled to the movable element 111, that will be free to be dragged by the roll 110, by the three movable elements 111, until reaching its complete display.

To bring back the board 102 within the container 101, the roll 110 rotates in an opposite direction with respect to the preceding one till bringing the board 102 with the hole 109 in correspondence of the pin 103. The container 101 is now lifted of a step, so that the pin 103 engages again the hole 109 of the board 102 formerly displayed and, sliding again along the slot 104 towards the bottom, brings back the board 102 within the container.

To display the next board 102, the container 101 is slided of a step downward, so that the pin 105 engages the hole 109 of the board formerly displayed.

Now, the pin 103, sliding upward along the slot 104, will bring the second board 102 in correspondence with the movable element 111 and the above described cycle can be repeated.

It is well evident that in this case too, suitably programming the stepping motor that controls the U notion of the container 101 it will be possible to determine the desired casual display sequence of the different boards 102.

Referring now to FIGS. 12 to 15, the embodiment shown provides two chains 201 each comprising twelve boards 202 connected by articulated joints to realize the chain structure so that each chain rotates about two pair of pinions 203, 204, the first ones (203) being idle and the second ones (204) being connected through the transmission 205 with a motor 206.

The chains 201 made up by single panels 202 are realized opposite and symmetrical each other and, employing idle wheels that allow a single rotation direction, the motion can be controlled by a single motor 206.

Figure 13:
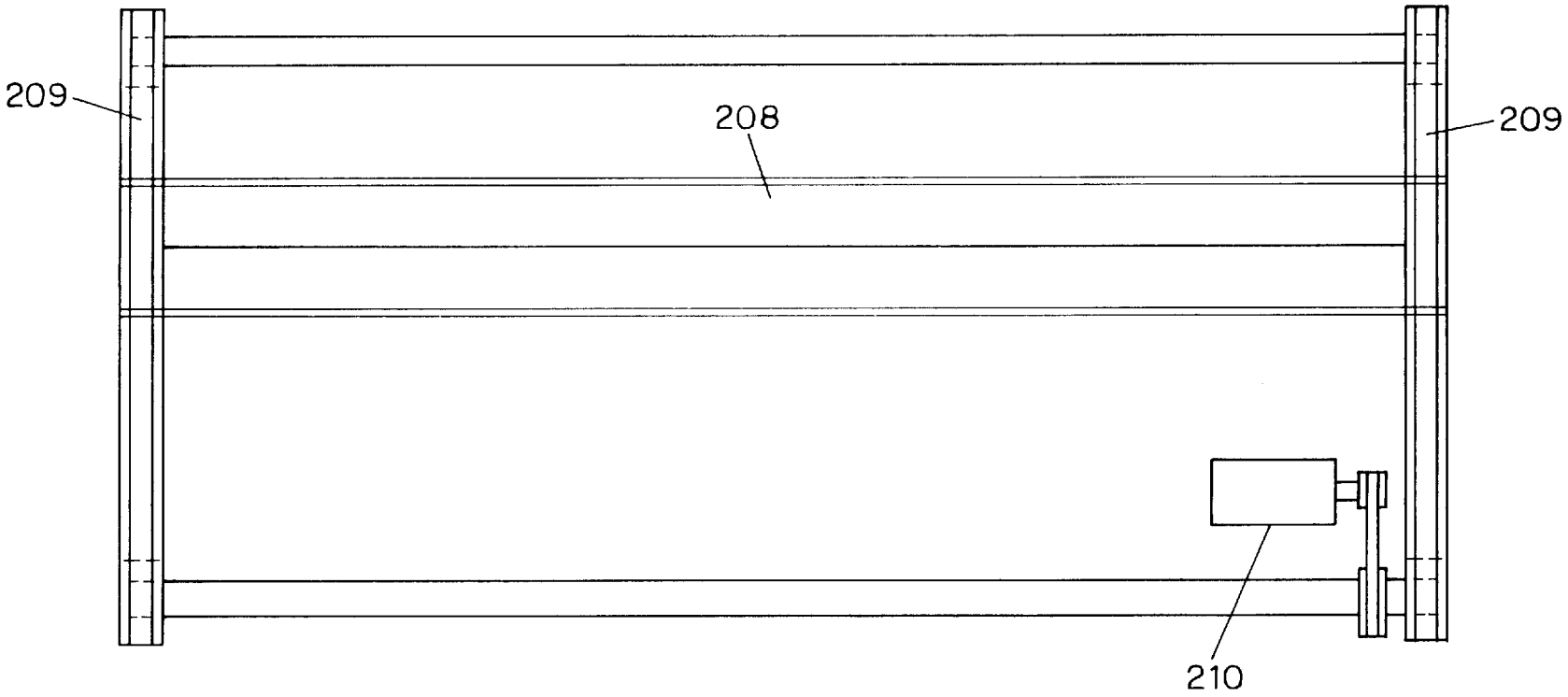
FIG. 13 is a front view of the displayer of FIG. 12.

Hooking and releasing of the board to be displayed is realized by a plurality of hooks 207 provided along a rigid bar 208, the ends of which are coupled to the links of two chains 209 moved by a motor 210 (see FIG. 13).

Figure 14:
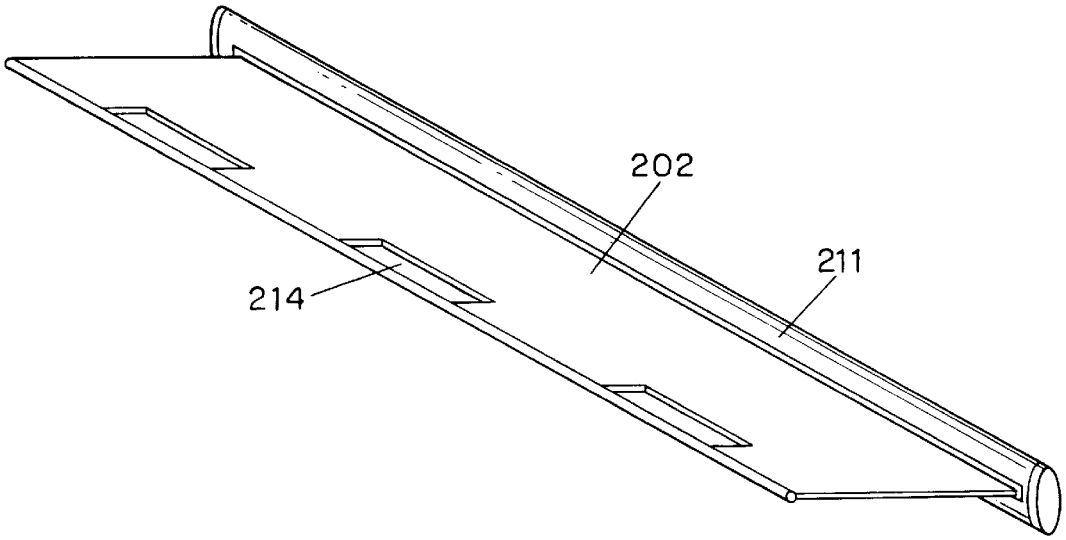
FIG. 14 is a perspective view of a board for an displayer according to the invention.
Figure 15:
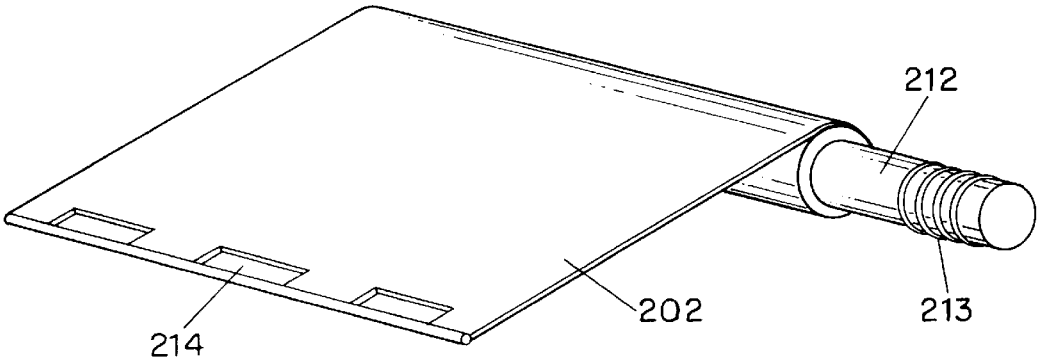
FIG. 15 is a partial view of the board of FIG. 14.

Each single board 202, see FIG. 14 and 15, is included within a container or "magazine" 211 comprising a hub 212, rotating inside the container 211, and having the board 202 rolled up on it, by the action of a spiral spring 213.

Along the edge of each board opposite to the edge coupled with the container 211, it is provided a number of openings 214 that couple with the hooks 207 of the rigid bar 208.

The programming of the display sequence of the different boards is realized in a way similar to the one already described with reference to the above mentioned embodiments.

In this case, by the motor 206, a board 202 from one of the two chains 201 is brought in a display position, and said board 202 will be displayed by the translation of the rigid bar 208, through the action of the system comprised of chains 209 and motor 210, said rigid bar 208 having grasped the board 202 involved by the coupling of the hooks 207 with the openings 214.

While displaying the board 202 according to the preestablished sequence, the rigid bar 208 determines the rolling up of the board 202 formerly displayed inside the corresponding roll 211 by the returning action of the spring 213.

It should be pointed out that this kind of board, as well as the display mechanism, can be used for the other embodiments too.

The present invention has been described with specific reference to its preferred embodiments, but is is to be understood that changes and/or modification can be introduced by those skilled in the art without departing from the scope of the invention as defined in the enclosed claims.

I claim:

1. Information displayer for displaying a plurality of interchangeable boards in a display position in any pre-selected sequence, comprising:

at least one set of board containers, each set containing a plurality of board containers interconnected together so that said plurality of board containers can be commonly driven;

a plurality of interchangeable boards, each said container containing one said board;

means for grasping a board to be displayed;

means for driving each set of board containers, said driving means moving boards into registry with said grasping means;

moving means for bringing the grasped board from said board container into a display position and for returning said board to said board container after display; and a controller for controlling said driving means to move said boards into registry with said grasping means in any pre-selected sequence for said grasping means to grasp the respective board so that said plurality of boards can be selectively displayed in said any pre-selected sequence.

2. The information displayer of claim 1 wherein said driving means further comprises at least one stepping motor having a plurality of steps, the number of steps corresponding to the number of board containers in said set.

3. The information displayer according to claim 1 wherein there are two sets of board containers, the board containers contained in each of said sets being interconnected together in an articulated chain rotating around a plurality of pinions, and wherein said driving means comprises at least one motor.

4. The information displayer according to claim 3, wherein said one motor drives said two sets of board containers in both rotational directions, said motor being drivably connected to at least one of said pinions for each said set.

5. The information displayer according to claim 1, wherein each of said boards comprises a flexible sheet, and each said board container comprises a cylindrical container having an internal hub over which the sheet rolls up, and a spring for automatically rolling up the sheet around the hub.

6. The information displayer according to claim 1, wherein said information displayer has a front portion, and wherein said moving means comprises a rigid bar provided on the front portion of the displayer, said rigid bar being moved by a motor coupled to said rigid bar by a motion transmission means, and wherein said grasping means comprises a plurality of coupling hooks mounted on said rigid bar.

7. The information displayer according to claim 6, wherein said motion transmission means includes a rotating chain.

* * * * *